US006526788B2

(12) United States Patent
Finkelstein et al.

(10) Patent No.: US 6,526,788 B2
(45) Date of Patent: Mar. 4, 2003

(54) WALK-IN FREEZER DOOR HANDLE AND LOCK ASSEMBLY

(75) Inventors: Burl Finkelstein, Newnan, GA (US); Thomas A. Thorsen, Moreland, GA (US)

(73) Assignee: Kason Industries, Inc., Shenandoah, GA (US)

( * ) Notice: Subject to any disclaimer, the term of this patent is extended or adjusted under 35 U.S.C. 154(b) by 0 days.

(21) Appl. No.: 09/833,255

(22) Filed: Apr. 5, 2001

(65) Prior Publication Data

US 2002/0148259 A1 Oct. 17, 2002

(51) Int. Cl.[7] ..... E05B 65/08; E05C 1/04

(52) U.S. Cl. ..... 70/129; 70/207; 70/212; 292/145; 292/147; 292/148; 292/DIG. 71

(58) Field of Search ..... 70/129, 207, 212; 292/DIG. 71, 145, 147, 148

(56) References Cited

U.S. PATENT DOCUMENTS

| | | | | | |
|---|---|---|---|---|---|
| 2,074,979 | A | | 3/1937 | Brantingson | 292/340 |
| 2,872,233 | A | * | 2/1959 | Bordner, Jr. | 292/92 |
| 3,599,453 | A | | 8/1971 | Bauernfeind | 70/129 |
| 4,229,956 | A | * | 10/1980 | Thorburn | 70/129 |
| 4,280,725 | A | * | 7/1981 | Berkowitz et al. | 292/223 |
| 4,565,079 | A | | 1/1986 | Smith | 70/134 |
| 4,635,977 | A | * | 1/1987 | Yamada | 292/92 |
| 4,704,882 | A | * | 11/1987 | Takasaki | 70/215 |
| 4,782,675 | A | | 11/1988 | Thorburn | 70/129 |
| 4,884,421 | A | * | 12/1989 | Lindsay | 70/129 |

* cited by examiner

*Primary Examiner*—Anthony Knight
*Assistant Examiner*—Christopher Boswell
(74) *Attorney, Agent, or Firm*—Baker, Donelson, Bearman & Caldwell

(57) ABSTRACT

A freezer door handle and lock assembly comprises a pull handle having a mounting end formed with a slot that is adapted to be mounted to a freezer door. A deadbolt is mounted in the pull handle mounting end for reciprocal movement along a path of travel between deadbolt locking and unlocking positions. A manual push bar extends from the deadbolt to the exterior of the handle mounting end through the mounting end slot. Means are provided for locking the deadbolt in its locking position. A strike is also provided for receiving the deadbolt.

3 Claims, 4 Drawing Sheets

WALK-IN FREEZER DOOR HANDLE AND LOCK ASSEMBLY

TECHNICAL FIELD

This invention relates generally to freezers and coolers and particularly to freezer door handles and locks.

BACKGROUND OF THE INVENTION

Walk-in freezers have doorways with doors to provide for controlled ingress and egress. To provide security the doors must be provided with locks. A deadbolt type lock is preferred as it provides a high level of security and is tamper resistant. In its simplest form a deadbolt lock consists of a bolt slidably mounted within a housing and attached to a door with a knob or handle for manually extending and retracting the bolt into and out of a recess in a doorjamb. The bolt is extended to prevent the door from being opened and retracted to allow the door to be opened.

Though deadbolts offer substantial security, their adaptation for use on freezer doors is difficult. For example, recessed deadbolts and apertures within a freezer door or doorjamb are hard to install due to the hollow metal construction of freezer walls. They also present a greater susceptibility to freeze-up since they are close to the interior of the chamber and the metal casing chamber wall are highly heat conductive. While surface mounted deadbolt locks might help solve this problem, such locks are not normally designed to provide for emergency inside release nor have padlock capabilities. Thus deadbolts actually impose a substantial danger to persons becoming trapped in the freezer who may suffer from hypothermia or even death if not discovered for a long time. It thus is essential that a deadbolt type lock for a freezer door be inside escape capable.

Accordingly it is seen that a need has long existed for a freezer door lock that has the security of deadlock type action coupled with emergency escape capability, all with minimal risk of freeze-up. It is to the provision of such that the present invention is primarily directed.

SUMMARY OF THE INVENTION

In its preferred form, a freezer door handle and lock assembly comprises a pull handle having a mounting end formed with a slot that is adapted to be mounted to a freezer door. A deadbolt is mounted in the pull handle mounting end for reciprocal movement along a path of travel between deadbolt locking and unlocking positions. A manual push bar extends from the deadbolt to the exterior of the handle mounting end through the mounting end slot. Means are provided for locking the deadbolt in its locking position. A strike is also provided which is adapted to be removably mounted to a door jamb in position to receive the deadbolt.

BRIEF DESCRIPTION OF THE DRAWING

FIG. 4 is a perspective view of a portion of the assembly with the deadbolt in its unlocked position while

DETAILED DESCRIPTION

Figure 1:
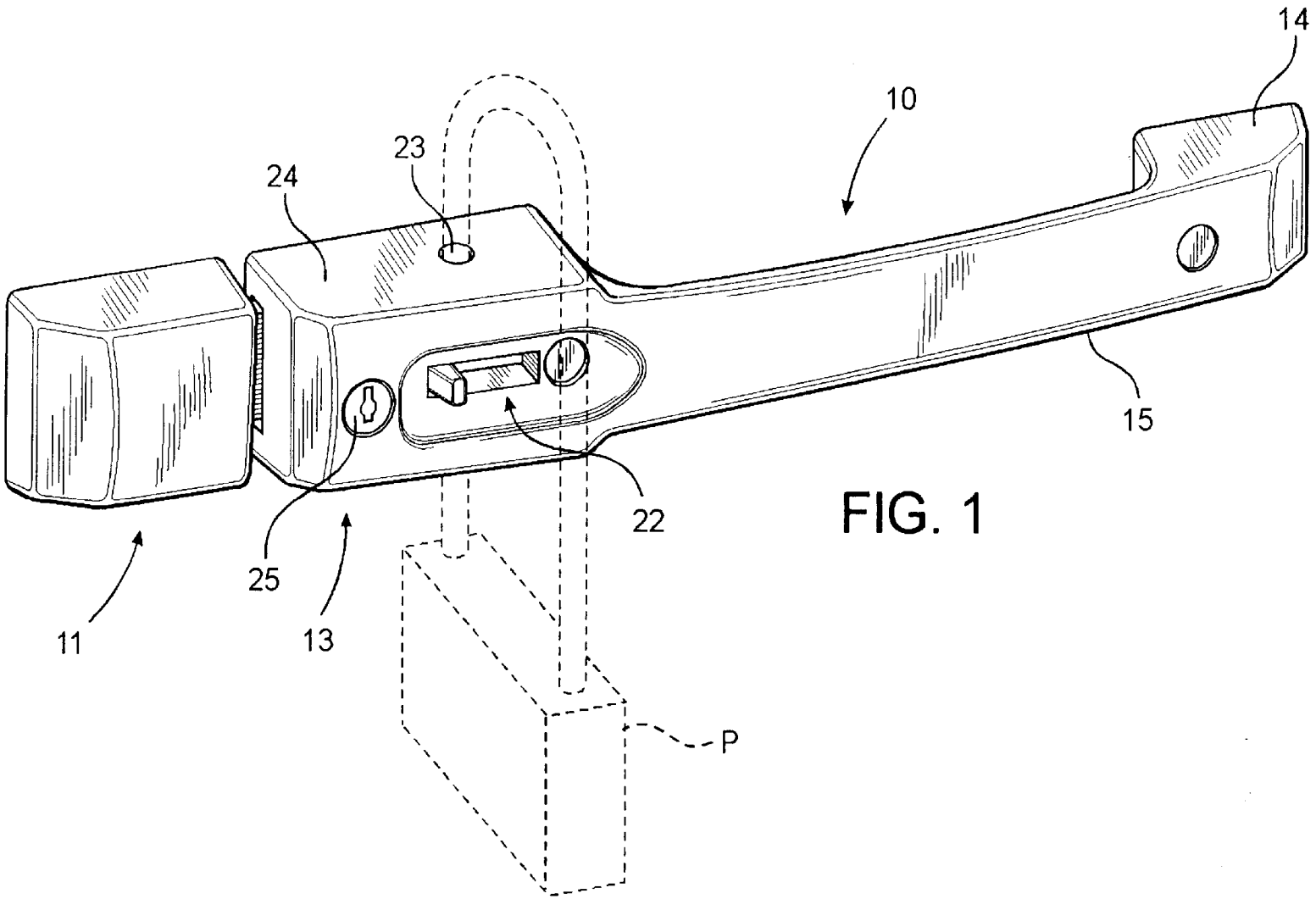
FIG. 1 is a perspective view of a freezer door handle and lock assembly that embodies the invention in its preferred form.

Referring now in more detail to the drawings, there is shown a freezer door handle and lock assembly that comprises a handle 10 and a strike 11. The handle has a relatively large mounting end 13 and a relatively small mounting end 14 that are spanned by a grip 15. The large handle end has a deadbolt 18 mounted therein for sliding, reciprocal movement upon two parallel rails 19 between its unlocked position shown in FIG. 4 and its locked position shown in FIG. 5. The deadbolt has a manual push bar 20 that protrudes out of a slot 22 in the face of the handle end 13. The handle end 13 has two aligned holes 23 in two opposite sides 24 that straddle the path of travel of the push bar 20 unitary component part of the deadbolt 18. These holes are located so that the push bar can be positioned to either side of them.

The handle end 13 is provided with a cylinder lock 25 that is operable with a key 26. This lock has a rotatable stop 28 that is formed with a slot-shaped keyway 29. This stop is rotatably located within the path of travel of a projection or lug 30 that unitarily projects from the deadbolt 18, the projection being sized to pass through the stop slot 29. Finally, the strike 11 has an emergency release device in the form of a rotatable handle 32 mounted to the end of a threaded rod 33.

Figure 2:
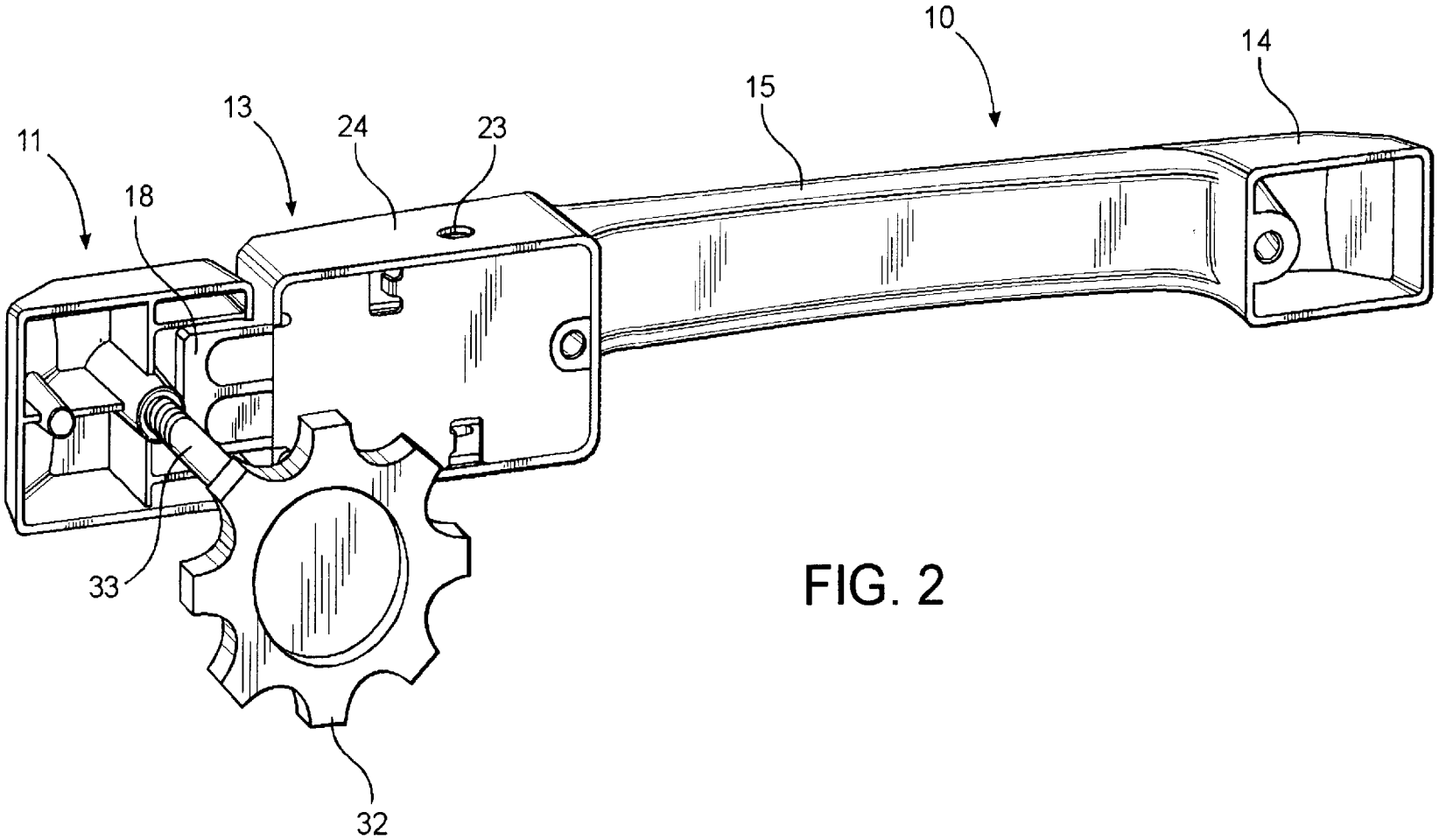
FIG. 2 is rear view, in perspective, of the assembly of claim 1.
Figure 3:
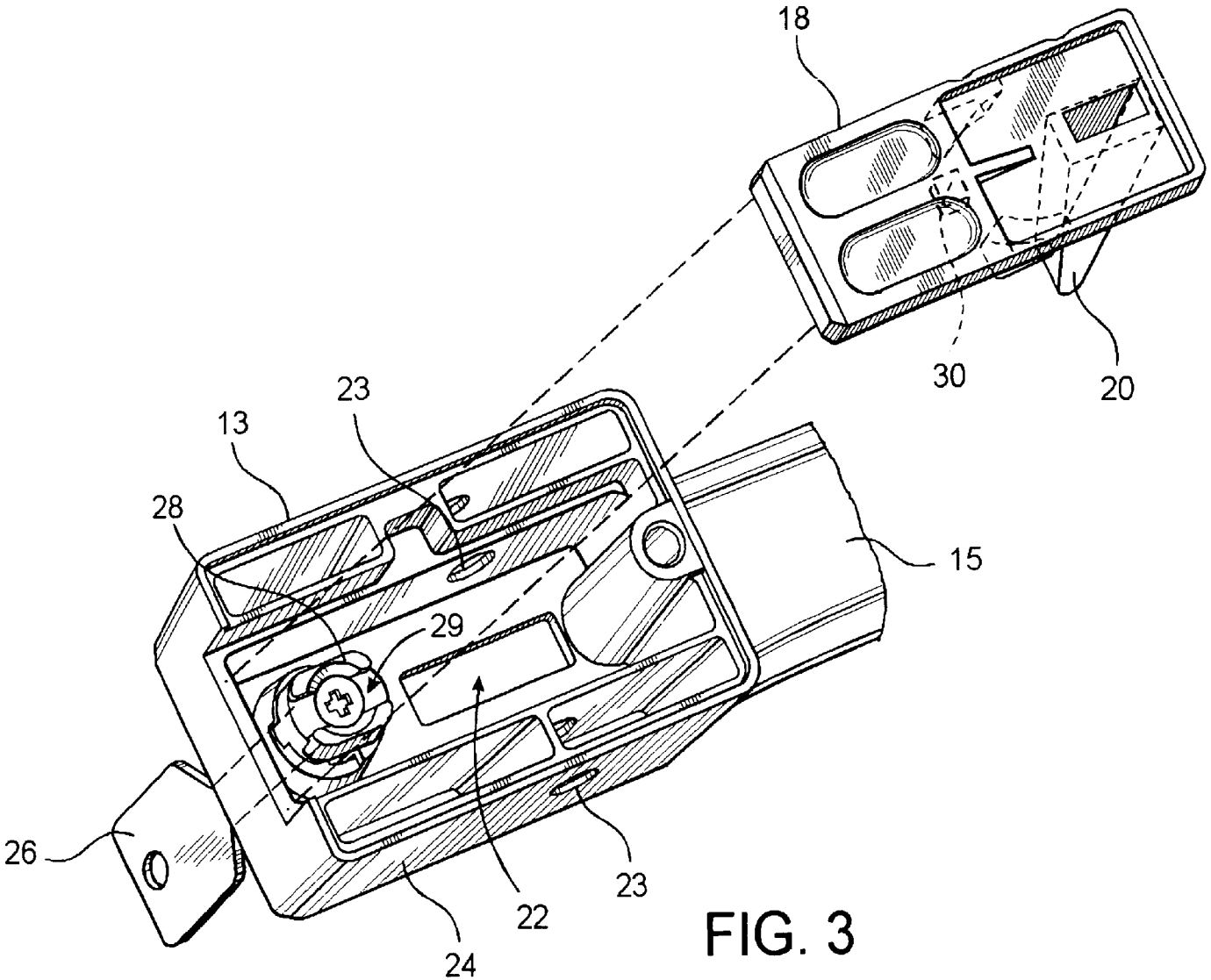
FIG. 3 is an exploded view, in perspective, of a rear portion of the assembly.
Figure 4:
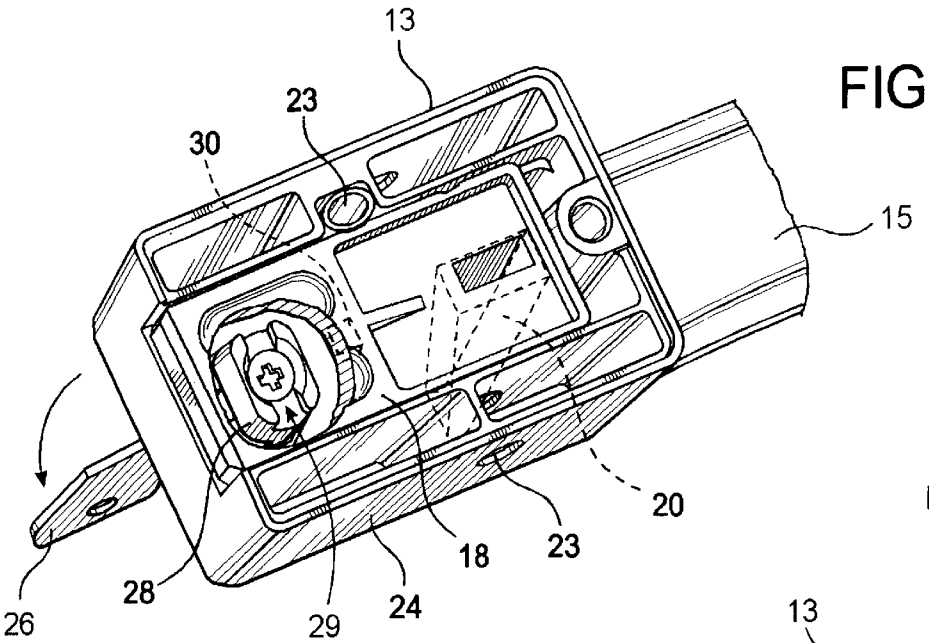
Figure 5:
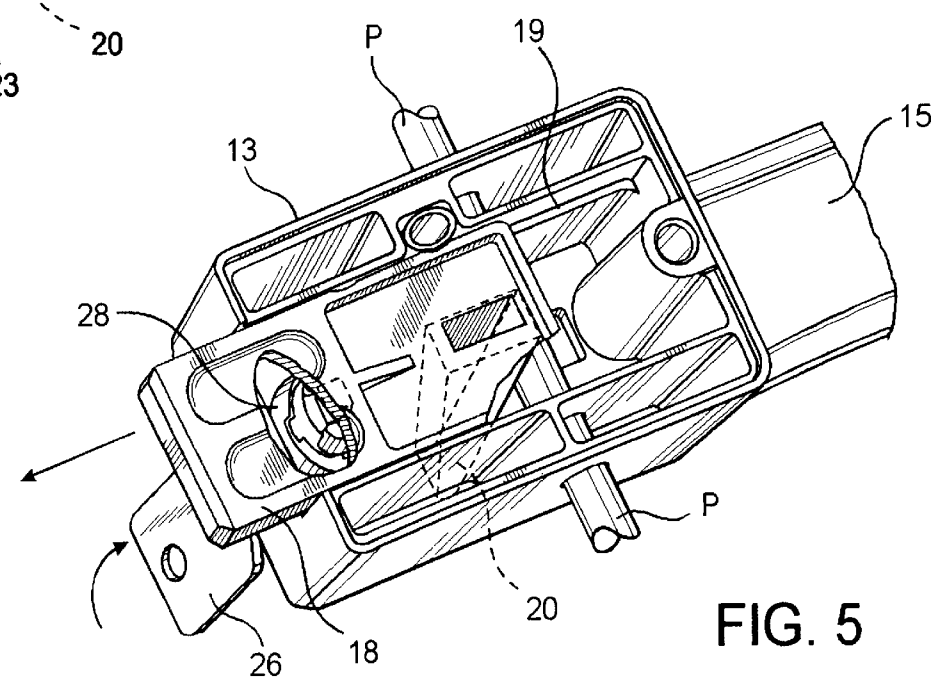
FIG. 5 shows the deadbolt in its locked position.

In use the handle 10 is mounted to the door of a walk-in freezer or cooler room with unshown screws and covered with below flush, push-in finishing plugs. The strike is mounted to the doorjamb by drilling a hole through the jamb and, using the emergency release handle inserted from the inside of the freezer, screwing it into the strike. The strike is mounted in alignment with the handle so as to receive its deadbolt. By manually pushing the push bar 20 the deadbolt may be moved to its unlocked position disengaged from the strike or to its locked position in engagement with the strike. The deadbolt may be locked in its closed position shown in FIGS. 1, 2 and 5 with a padlock P by inserting its shank through the holes 23 in the sides of the handle end 13. Should someone become locked inside the freezer he or she could nevertheless escape by rotating the inside release handle 32 until it comes clear of and separated from the strike 11 which would then become dismounted from the doorjamb. Note that the padlock could be used either to lock the door closed or open. The key-operated cylinder lock could also be used to lock the door open as shown in FIG. 4 where its slot 29 is oriented transverse to the path of travel of the projection or lug 30.

It thus is seen that a freezer door handle and lock assembly is now provided of freeze resistant construction that provides the security of deadbolt operation coupled with emergency escape capability. Although it has been shown and described in its preferred form, it should be understood that many modifications may be made thereto without departure from the spirit and scope of the invention as set forth in the following claims.

What is claimed is:

1. A freezer door handle and lock assembly comprising, in combination, a pull handle having a mounting end formed with a slot and adapted to be mounted to a freezer door, a deadbolt mounted in said pull handle mounting end for reciprocal movement along a path of travel between deadbolt locking and unlocking position, a manual push bar that extends from said deadbolt to the exterior of said handle mounting end through said slot, means for locking said deadbolt in said deadbolt locking position, and a strike adapted to be removably mounted to a doorjamb positioned to receive said deadbolt.

2. The freezer door handle and lock assembly of claim 1 further comprising a key cylinder lock having a stop with a keyway rotatably mounted within said deadbolt path of travel.

3. The freezer door handle and lock assembly of claim 1 wherein said locking means comprises a padlock and wherein said pull handle mounting end has two opposite sides with aligned channels therethrough sized to receive a shackle of said padlock therethrough traversing said deadbolt path of travel.

* * * * *